US009777509B2

(12) United States Patent
Minter et al.

(10) Patent No.: US 9,777,509 B2
(45) Date of Patent: Oct. 3, 2017

(54) FLUSH LOCK FOR CASEMENT WINDOW AND METHOD OF OPERATING THE SAME

(71) Applicant: Interlock USA, Inc., Reno, NV (US)

(72) Inventors: Peter J. Minter, Reno, NV (US); Mathew D. Ruspil, Reno, NV (US)

(73) Assignee: Interlock USA, Inc., Reno, NV (US)

( * ) Notice: Subject to any disclaimer, the term of this patent is extended or adjusted under 35 U.S.C. 154(b) by 0 days.

(21) Appl. No.: 14/793,820

(22) Filed: Jul. 8, 2015

(65) Prior Publication Data

US 2015/0308151 A1 Oct. 29, 2015

Related U.S. Application Data

(62) Division of application No. 13/610,789, filed on Sep. 11, 2012, now Pat. No. 9,109,384.

(51) Int. Cl.

| | |
|---|---|
| ***E05C 19/10*** | (2006.01) |
| ***E05B 5/00*** | (2006.01) |
| ***E05C 9/10*** | (2006.01) |
| ***E05B 15/00*** | (2006.01) |
| *E05C 1/06* | (2006.01) |
| *E05C 1/12* | (2006.01) |
| *E05C 1/04* | (2006.01) |
| *E05C 1/10* | (2006.01) |
| *E05B 3/00* | (2006.01) |

(52) U.S. Cl.

CPC ..... *E05B 5/006* (2013.01); *E05B 5/00* (2013.01); *E05B 15/0006* (2013.01); *E05C 9/10* (2013.01); *E05C 19/10* (2013.01); *Y10T 292/0951* (2015.04)

(58) Field of Classification Search

CPC ..... E05B 5/0006; E05B 5/00; E05B 15/0006; E05B 85/22; E05C 9/10; E05C 19/10; E05C 17/14; E05C 9/02; E05C 19/028; E05C 1/00; E05C 1/002; E05C 1/004; E05C 1/006; E05C 1/02; E05C 1/08; E05C 17/48; E05C 2001/008; E05C 9/028; E05C 9/20; E05C 9/22

USPC ..... 292/101, 158, 160, 162, 336.3

See application file for complete search history.

(56) References Cited

U.S. PATENT DOCUMENTS

| | | | | |
|---|---|---|---|---|
| 3,949,525 | A | 4/1976 | Bates et al. | |
| 4,674,777 | A | 6/1987 | Guelck | |
| 4,803,808 | A | 2/1989 | Greisner | |
| 4,823,508 | A | 4/1989 | Allen | |
| 4,937,976 | A | 7/1990 | Tucker et al. | |
| 4,976,066 | A * | 12/1990 | Plummer | E05D 15/08 49/219 |
| 4,991,886 | A | 2/1991 | Nolte et al. | |

(Continued)

*Primary Examiner* — Kristina Fulton
*Assistant Examiner* — Faria Ahmad
(74) *Attorney, Agent, or Firm* — Delio, Peterson & Curcio LLC; Robert Curcio

(57) ABSTRACT

A low profile actuating window lock for casement windows having a handle actuate a lifter that slides vertically on a fork component in slidable communication with the window lock casing, the handle pivotable about the lifter and pivotable about a restrictor arm that pivots relative to the casing, allowing the handle to rotate fully from the locked position to the unlocked position with low clearance from the window frame. The pivot points of the handle, lifter, restrictor arm configuration allow for an over center linkage that prevents back driving the casement window lock.

6 Claims, 14 Drawing Sheets

(56) References Cited

U.S. PATENT DOCUMENTS 5,050,345 A 9/1991 Nakanishi
5,054,239 A 10/1991 Tucker et al.
5,087,087 A 2/1992 Vetter et al.
5,118,145 A 6/1992 Tucker
5,152,103 A * 10/1992 Tucker ..... E05F 11/16 49/279
5,219,195 A 6/1993 Lawrence
5,318,333 A * 6/1994 Dreifert ..... E05C 9/02 292/336.3
5,323,568 A 6/1994 Blomqvist
5,370,428 A * 12/1994 Dreifert ..... E05C 9/185 292/161
5,531,045 A 7/1996 Piltingsrud
5,618,068 A 4/1997 Mitsui et al.
D388,689 S 1/1998 Bauman et al.
D390,445 S 2/1998 Johnson et al.
5,741,031 A 4/1998 Bauman et al.
5,778,602 A 7/1998 Johnson et al.
5,813,710 A 9/1998 Anderson
5,829,802 A * 11/1998 Anderson ..... E05B 7/00 292/139
5,927,768 A 7/1999 Dallmann et al.
6,109,668 A 8/2000 Demarco
6,230,457 B1 5/2001 Brautigam
6,354,639 B1 3/2002 Minter et al.
6,367,853 B1 4/2002 Briggs
6,425,611 B1 * 7/2002 Minter ..... E05B 7/00 292/336.3
6,431,620 B2 * 8/2002 Tremblay ..... 292/263
6,434,887 B2 * 8/2002 Nakanishi ..... 49/246
6,450,554 B1 * 9/2002 Rotondi ..... E05C 9/02 292/139
6,651,389 B2 * 11/2003 Minter ..... E05C 9/02 292/302
6,672,010 B1 * 1/2004 Gledhill ..... E05F 11/34 49/339
6,767,038 B1 * 7/2004 Huml ..... E05C 9/02 292/137
6,837,004 B2 1/2005 Annes
7,617,707 B2 * 11/2009 Chiang ..... E05B 13/10 292/336.3
7,708,322 B2 * 5/2010 Timothy ..... E05C 9/063 292/137
7,823,935 B2 * 11/2010 Norris ..... E05C 9/02 292/161
7,900,322 B2 * 3/2011 Doring ..... E05D 15/30 16/362
7,946,633 B2 5/2011 Minter
8,353,541 B2 * 1/2013 Minter ..... E05C 9/10 292/137
8,448,996 B2 * 5/2013 Lake ..... E05B 7/00 292/111
8,683,746 B2 * 4/2014 Lambertini ..... E05F 11/16 49/246
8,726,572 B2 * 5/2014 Derham ..... E05C 19/003 49/141
9,109,384 B2 * 8/2015 Minter ..... E05C 19/10
2001/0013202 A1 * 8/2001 Nakanishi ..... E05D 15/30 49/250
2002/0066162 A1 * 6/2002 Van Klompenburg . E05F 11/16 16/429
2003/0079414 A1 * 5/2003 Rangabasyam ..... E05C 9/02 49/395
2008/0256874 A1 * 10/2008 Curtis ..... E05D 15/30 49/399
2012/0036781 A1 * 2/2012 Runk ..... E05C 17/24 49/181
2012/0180392 A1 * 7/2012 Lambertini ..... E05F 11/16 49/336
2013/0104458 A1 * 5/2013 Leung ..... E05C 17/28 49/13
2014/0070547 A1 * 3/2014 Minter ..... E05C 19/10 292/101

* cited by examiner

FLUSH LOCK FOR CASEMENT WINDOW AND METHOD OF OPERATING THE SAME

BACKGROUND OF THE INVENTION

1. Field of the Invention

The present invention is directed towards window locks, and particularly toward manual handles for actuating window locks. Specifically, the present invention is directed to a flush mount or low profile actuating window lock for casement windows. More specifically, the present invention is directed to a flush mounted lock actuator designed to drive a lock bar that locks and unlocks a casement window, and protrudes from the window frame significantly less than prior art designs while employing linkage to prevent the actuator from being back driven from either the locked position or unlocked position. The present invention introduces a lifter and a restrictor arm that shift the pivot points of the handle. The lifter moves vertically relative to a horizontally driving fork component helping to achieve a low profile actuation of the lock.

2. Description of Related Art

Generally, a casement window is a window unit in which the single vent cranks outward, to the right or left. Casement windows are hinged at the side. (Windows hinged at the top are referred to as awning windows.) They are used singly or in pairs within a common frame. Casement windows are often held open using a casement stay. Casement windows open like doors. Like doors, either the left or right side is hinged (or, more accurately, pivoted), and the non-hinged side locks securely into place by a lock bar driven by a lock handle. Unlike a door, the casement window opens not by a knob or handle but by means of some variation of a gear driven operator or lever, which is placed around hand height or at the bottom. A gear driven operator, stay, or friction hinge controls the position of the sash is necessary when the window opens outward, to hold the window in position during inclement weather, such as high winds.

The locking system for a casement window is typically on the side of the window. Lock handles for casement windows are known in the art. Generally, a lock handle is mounted on the frame of the casement window and moves an internally mounted fork component left or right. The fork component drives a lock or tie bar that is also mounted to the frame. One type of locking mechanism for a casement window uses a flat tie bar slidably mounted to the window frame along the open side of the window. The tie bar is provided with multiple pins for locking and driving that extend perpendicularly outward from the tie bar. A locking handle is provided on the interior of the window frame that can be thrown by the user between locked and unlocked positions. The locking handle slides the tie bar, which moves each locking pin between a corresponding locked and unlocked position. A typical lock bar and lock handle to drive the lock bar is shown in U.S. Pat. No. 7,946,633, entitled "Low Friction Adjustable Roller Pin," issued to Minter on May 24, 2011.

Lock handles of the prior art are known to protrude from the casement window frame at a distance of approximately 20-25 mm. This protrusion is due to the internal driving mechanism within the handle. Casement window lock handles of the prior art drive a fork component, which engages and slides the lock bar. In order to drive the fork component from one side to the other, the handle casing must have sufficient depth to allow for the handle to pivot about the casing and to allow the fork internally to shift from side to side.

The most relevant prior art does not teach or disclose a locking mechanism capable of low profile (on the order of 8 mm) flush mounting that can be adapted to work with existing tie bar locking designs. For example, in U.S. Pat. No. 5,087,087 issued to Vetter, et al., on Feb. 11, 1992, entitled "Sash Lock," a basic multipoint window lock mechanism is taught using an actuating lever/handle that drives a sliding lock bar. The actuating lever handle has a pin located at the opposite end from the handle end. The pin is engaged in and drives a fork component on the lock bar. This prior art does not disclose, describe, or suggest any type of lifter mechanism in combination with the fork component to achieve a significantly reduced profile lock actuation. Nor does this prior art design introduce additional linkage to prevent back driving the lock.

In U.S. Pat. No. 5,813,710 issued to Anderson on Sep. 29, 1998, entitled "Flush Lock Actuator," a lock actuator is disclosed to provide a "flush" lock appearance. However, for reasons discussed further herein, the low profile feature of this invention is provided with a design distinctly different from the present design. The Anderson design teaches a handle that is symmetrical and flush with the body of the actuator. The handle is pivoted with respect to the casing about its center on a pin. One end of the handle pivots towards (and into) the window frame, while the other end pivots out of the body and away from the frame. The end that pivots into the window has an actuating link attached to it that drives the lock bar. There is no "lifter" as taught by the present invention to work in combination with a fork component to reduce the casing profile, nor a restrictor arm for redirecting the pivot points of the handle, nor is there any linkage or over center action to prevent back driving the lock.

In U.S. Pat. No. 5,829,802 issued to Anderson, et al., on Nov. 3, 1998, entitled "Multi-Point Lock Operator For Casement Window," a lock actuator is disclosed that drives a multipoint lock bar. Although the actuator handle is not flush, the handle swings a full 180° so that it lies flat at both the locked and unlocked limits of motion. The far end of the actuator handle drives a "universal" link that is connected to the lock bar. In this design, the handle is pivoted directly on the casing or body of the device, which is distinctly different than the present design. Consequently, there is no need for a restrictor arm or any additional linkage for over center security to prevent the lock handle from being back driven.

In general, the prior art is silent with respect to salient features of the present invention that achieve flush mounting and prevent back driving the lock.

BRIEF SUMMARY OF THE INVENTION

Bearing in mind the problems and deficiencies of the prior art, it is therefore an object of the present invention to provide a casement window lock that is flush mounted with a significantly lower profile than the current state of the art.

It is a further object of the present invention to provide a casement window lock that allows for complete reversal of the handle from the locking position to the unlocking position, and vice versa.

In yet another object of the present invention, it is desirable to provide a casement window lock that prevents back driving the locking mechanism.

The above and other objects, which will be apparent to those skilled in the art, are achieved in the present invention which is directed to a casement window lock for securing a window sash to a casement window frame, the lock comprising: an elongated casing having a substantially horizontal sidewall section and a vertical section shorter in length than the sidewall section; a fork component adapted to engage a lock bar external to the lock, the fork component in slidable communication with the casing; a lifter in slidable communication with the fork component; a restrictor arm pivotally attached to the casing; and a handle pivotally attached at one end to the lifter, and pivotally attached at an intermediate point on the handle to the restrictor arm; wherein upon rotation the handle engages the lifter to move the fork component horizontally along the casing horizontal sidewall section while simultaneously lifting or lowering the lifter relative to the fork component.

In the preferred embodiment, the casing may include a first track for slidably engaging the fork component, and a second track for slidably engaging the lifter, the first track positioned horizontally about the casing horizontal sidewall section, and the second track having an angled portion slanting vertically relative to the horizontal position of the first track.

Similarly, in the preferred embodiment, the fork component may include a track for slidably communicating with the lifter such that the lifter moves vertically relative to the fork component when engaged by the handle.

It is advantageous for the design of the casement window lock to include a plurality of hinges or pivot points forming an over center linkage to prevent back driving the lock, wherein the over center linkage includes: a first hinge point rotatably joining the handle to the lifter; a second hinge point rotatably joining the handle to the restrictor arm; and a third hinge point rotatably joining the restrictor arm to the casing; such that when the handle is in an unlocked position, the first hinge point is between the second and third hinge points, and the second hinge point is below an action line connecting the first and third hinge points, and when the handle is in the locked position, the second hinge point is between the first and third hinge points, and the second hinge point is below an action line connecting the first and third hinge points.

The over center linkage may also be considered a four bar linkage construction, that is formed by: a first bar formed by the handle between a pivot connected at the lifter and a pivot connected at the restrictor arm; a second bar formed by the restrictor arm and pivoting at each end thereof; a third bar formed by the lifter and the lifter's relative vertical motion between the pivot point where the lifter connects to the handle, and the fork component; and a fourth bar formed by the fork component and horizontal sliding motion of the fork component relative to a fixed pivot point of the restrictor on the casing.

The fork component includes an extension attached to or integral with the fork component, extending perpendicular to the horizontal casing sidewall section for slidable engagement within the first track.

The lifter includes a protrusion attached to or integral with the lifter, extending perpendicular to the horizontal casing sidewall section for slidable engagement with the second track.

Generally, the casement window lock will have a slotted escutcheon attached to the casing.

To secure the lock to a window frame, the lock will employ a retainer comprising a retainer body and a brush seal, wherein the retainer is placed on a window frame opposite the casement window lock, providing a surface for mounting screws through the window frame to the lock.

In a second aspect, the present invention is directed to a casement window lock for securing a window sash to a casement window frame, the lock comprising: a casing having an elongated horizontal sidewall with a shorter vertical dimension, the casing including elongated side members, and tracks on at least one side member extending along an inside surface thereof, the tracks including a first track substantially horizontal and extending along the casing elongated horizontal sidewall, and a second track having at least one angled portion extending vertically relative to the first track's horizontal position; a restrictor arm pivotally attached at one end to the casing, and pivotally attached at the other end to a handle; a fork component including: an attachment portion for engaging a lock bar; an attachment for slidably retaining a lifter; and a protrusion for slidably engaging the first track; the lifter in slidable contact with the fork, including: an extending protrusion for slidably engaging the second track; and an attachment for pivotally connecting the lifter to the handle; and the handle in pivotal communication with the restrictor arm at one end of the handle, and in pivotal communication with the lifter at an intermediate point on the handle; wherein, when the handle is rotated to unlock the lock, the handle pivots about the lifter and the restrictor arm, respectively, causing the fork component to traverse horizontally in a first direction about the first track while simultaneously causing the lifter to shift vertically as the lifter traverses the second track, and when the handle is rotated to lock the lock, the handle pivots about the lifter and the restrictor arm, respectively, causing the fork component to traverse horizontally in a second direction opposite the first direction about the first track while simultaneously causing the lifter to shift vertically as the lifter traverses back on the second track.

In a third aspect, the present invention is directed to a method of locking a casement window having: an elongated casing with a substantially horizontal sidewall section and a vertical section shorter in length than the sidewall section; a fork component adapted to engage a lock bar external to the lock, the fork component in slidable communication with the casing; a lifter in slidable communication with the fork component; a restrictor arm pivotally attached to the casing; and a handle pivotally attached at one end to the lifter, and pivotally attached at an intermediate point on the handle to the restrictor arm; the method comprising: rotating the handle to engage the lifter and move the fork component horizontally along the casing horizontal sidewall section while simultaneously vertically shifting the lifter relative to the fork component to allow the handle to fully rotate approximately 180° from an initial position.

The method further includes causing an over center condition by rotating the handle fully to an unlocked position such that: a first hinge point, rotatably joining the handle to the lifter, is placed between a second hinge point, rotatably joining the handle to the restrictor arm, and a third hinge point, rotatably joining the restrictor arm to the casing, and the second hinge point is below an action line connecting the first and third hinge points; and causing an over center condition by rotating the handle fully to a locked position such that: the second hinge point is placed between the first and third hinge points, and the second hinge point is below an action line connecting the first and third hinge points.

In a fourth aspect, the present invention is directed to a method of securing a window sash to a casement window frame, said method comprising: actuating a flush lock for the casement window, wherein the casement window includes an elongated casing having a substantially horizontal sidewall section and a vertical section shorter in length than the sidewall section, and the flush lock includes: a fork component adapted to engage a lock bar external to the lock, the fork component in slidable communication with the casing;

a lifter in slidable communication with the fork component; a restrictor arm pivotally attached to the casing; a plurality of hinges or pivot points forming an over-center linkage to prevent back driving the lock, wherein the over-center linkage includes: a first hinge point rotatably joining the handle to the lifter; a second hinge point rotatably joining the handle to the restrictor arm; a third hinge point rotatably joining the restrictor arm to the casing; and such that when the handle is in an unlocked position, the first hinge point is between the second and third hinge points, and the second hinge point is below an action line connecting the first and third hinge points, and when the handle is in the locked position, the second hinge point is between the first and third hinge points, and the second hinge point is below an action line connecting the first and third hinge points; a handle pivotally attached at one end to the lifter, and pivotally attached at an intermediate point on the handle to the restrictor arm; rotating the handle to engage the lifter; moving the fork component horizontally along the casing horizontal sidewall section; and simultaneously lifting or lowering said lifter relative to the fork component.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DETAILED DESCRIPTION OF THE INVENTION

In describing the preferred embodiment of the present invention, reference will be made herein to FIGS. 1-19 of the drawings in which like numerals refer to like features of the invention.

The lock of the present invention is a low profile, flush design, that protrudes from the window frame significantly less than the prior art, at about 8 mm compared to 25 mm in the current prior art designs. When locking a casement window, the window is closed generally by a crank. The strikes on the moving sash are brought close to the pins on a tie bar mounted to the non-moving window frame. The lock handle is then thrown. This drives a fork component within the lock, which engages the tie bar and drives it, moving the tie bar pins into engagement with corresponding hooks or strikes. The fork component is preferably a flat structure adapted to slide within the lock casing, preferably having two extensions, such as leg portions, for engaging a tie bar. The strikes generally have a ramp surface at their mouth and the pins slide up this ramp into engagement. This motion pulls the sash tightly against the window frame generating compression for sealing the sash to the window frame.

To achieve this "flush," low profile appearance, the locking mechanism of the present invention introduces a "lifter" that slides vertically with respect the fork component as the fork component transitions horizontally along the elongated sidewall of the casement window lock. In prior art designs, the handle directly drives a fork component or the tie bar—structural limitations that result in a higher profile appearance. In the present design, the handle drives a lifter that is in slidable contact with the fork component. The lifter can "lift" relative to the fork, but cannot move left or right relative to the fork. This indirect drive of the fork through the lifter allows the handle to move more deeply into the mechanism to reduce the height of the lock casing.

Figure 1:
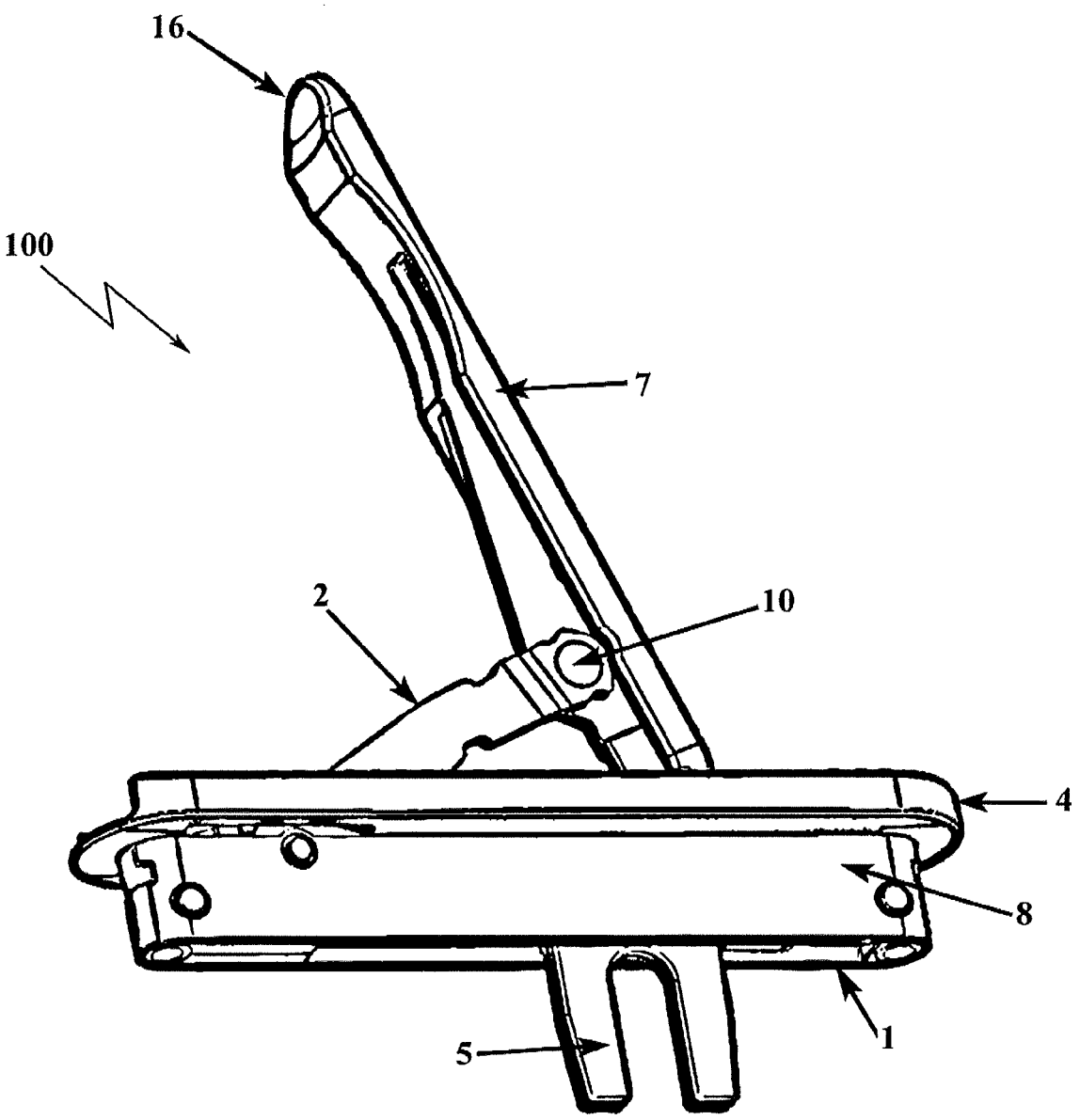
FIG. 1 depicts a perspective view of the flush lock handle mechanism casement window lock of the present invention.

FIG. 1 depicts a perspective view of the flush lock mechanism 100 of the present invention. This lock is mounted to the frame of a casement window (not shown). The lock mechanism 100 includes a lever arm or handle 7, pivotable about a restrictor arm 2 through a hinge or pivot pin 10. For exemplary purposes only, the elongated sidewalls of the casing will be deemed to be in a horizontal direction, designated by the H-arrow, and movement by fork component 5 will be considered movement in the horizontal direction, while the vertical direction, designated by the V-arrow, will represent movement perpendicular to the horizontal direction. These assigned directions are provided only to facilitate descriptions regarding movement of components with respect to the casement window lock; they do not represent direction of the casement window lock after it is mounted on a window frame. (It is noted that casement window locks are generally mounted so that the elongated casing is positioned vertically.)

Preferably, restrictor arm 2 is riveted to handle 7; however, other attachment schemes may be employed provided handle 7 is rotatably attached to restrictor arm 2 at the desired pivot location. Pivot pin 10 is preferably located at an intermediate point on handle 7 between the handle endpoints at a distance closer to the main casing 1 and escutcheon 4 than the handle's grip portion end 16. This allows for greater mechanical leverage by a user when pulling handle 7 upwards or pushing handle 7 downwards by grip portion end 16. Flush lock handle mechanism 100, in its operating condition, is encased in escutcheon 4, main casing 1, and casing cover 8.

Figure 2:
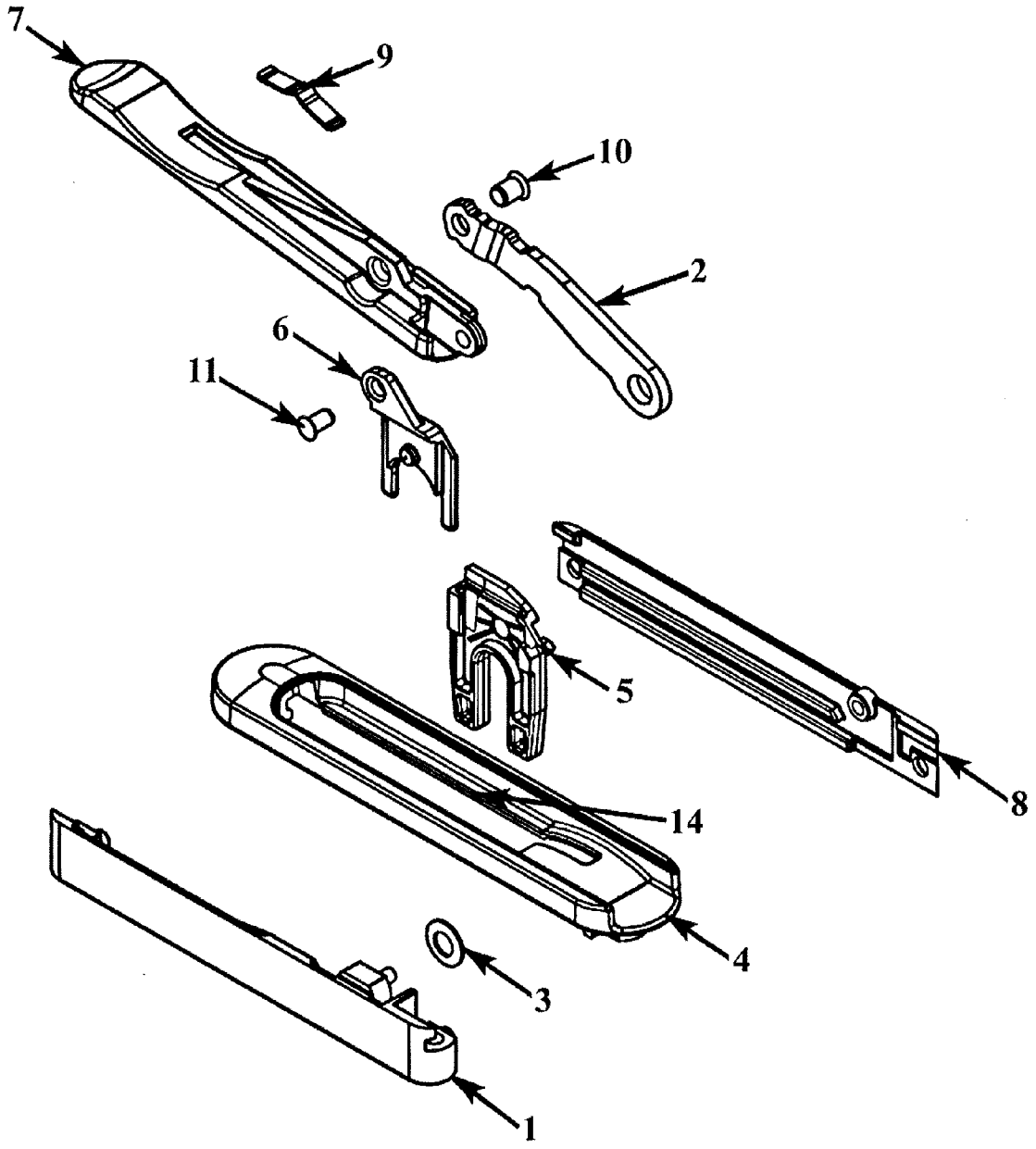
FIG. 2 is an exploded view of the flush lock handle mechanism of FIG. 1.

FIG. 2 is an exploded view of the flush lock handle mechanism 100. A fork component 5 is employed that is similar to some prior art designs, insomuch as a fork component is used to engage a tie bar during locking and unlocking actuation. Fork component 5 drives a tie bar or lock bar that is mounted to the frame. The tie bar engages a series of strikes that are mounted to the moving sash. Once the tie bar is engaged with the strikes, the window is locked. Unique to the present invention is a lifter component or "lifter" 6. One end of handle 7 pivotally connects to lifter 6 via hinge or pivot pin 11, which may be a rivet or other rotatable, pivoting attachment. In the preferred embodiment, handle 7 does not directly connect to escutcheon 4 or main casing 1 or fork 5. Upon actuation of handle 7, lifter 6 will shift vertically upwards and downwards relative to fork component 5.

Escutcheon 4 includes a central slot 14 to accommodate the horizontal movement of fork component 5 by handle 7 that establishes the locking and unlocking functions. Slot 14 provides an elongated aperture to accommodate the full range of motion of fork 5 and lifter 6 when these components are actuated by handle 7. Main casing 1 and casing cover 8 form sidewalls for escutcheon 4 and enclose the locking mechanism's moving components.

Figure 3:
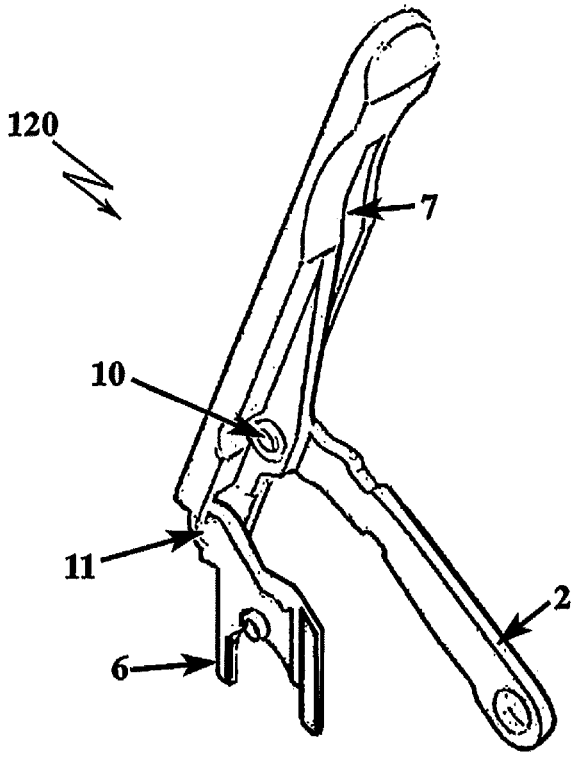
FIG. 3 depicts a perspective view of a sub-assembly of the flush lock mechanism of FIG. 1 showing the connection scheme of the handle, restrictor arm, and lifter.

FIG. 3 depicts a sub-assembly 120 of the flush lock mechanism. This figure illustrates the connection of handle 7 to restrictor arm 2 via pivot pin 10 at an intermediate point from each end of handle 7, as well as the connection of lifter 6 to an end of handle 7, rotatable about a hinge, pivot pin 11. As shown, handle 7 is designed to pivot about restrictor arm 2 and lifter 6 via pivot pins 10 and 11, respectively. Unlike the prior art, handle 7 is not directly connected to, nor does it pivot directly about, main casing 1, escutcheon 4, or fork component 5. As discussed further herein, this linkage contributes to the low profile design of the lock mechanism and the over center operation that prohibits back driving the flush lock mechanism.

Figure 4:
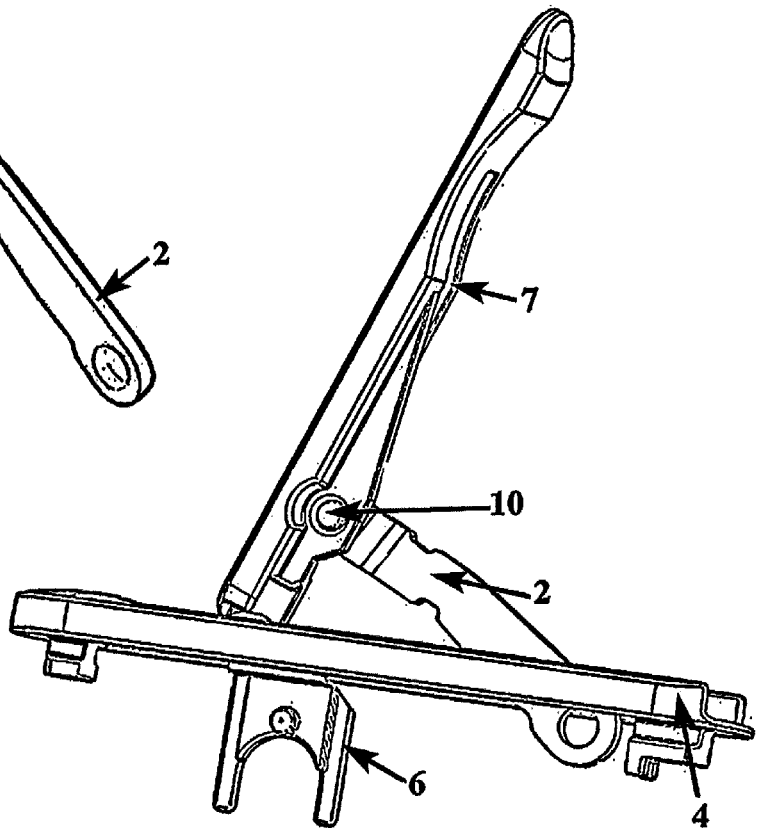
FIG. 4 depicts a perspective view of sub-assembly of FIG. 3 placed through a slot within the escutcheon.

FIG. 4 depicts a perspective view of sub-assembly 120 placed through slot 14 of escutcheon 4.

Figure 5:
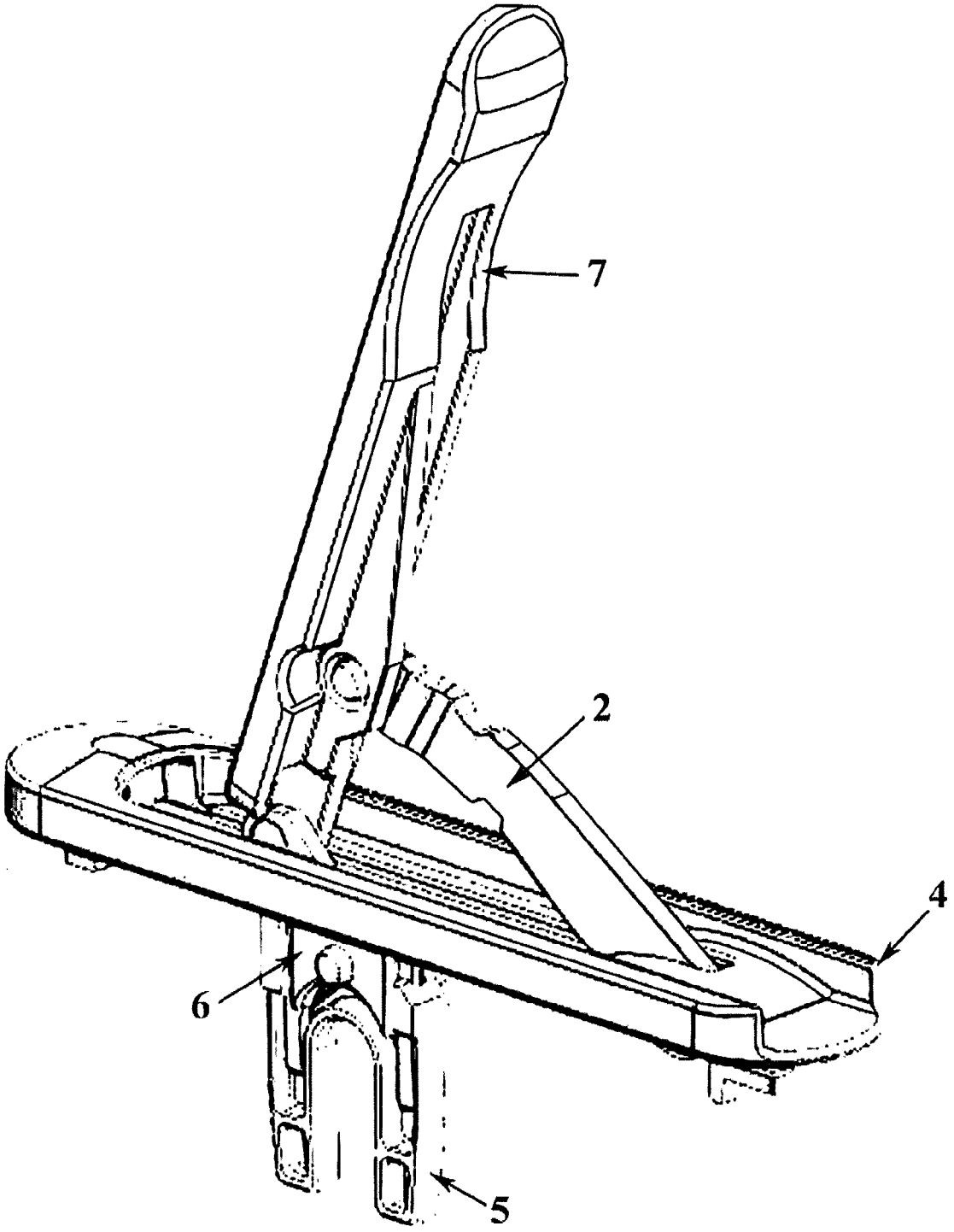
FIG. 5 depicts the sub-assembly of FIG. 3 with the fork component slidably mounted on a lifter.

FIG. 5 depicts sub-assembly 120 with fork component 5 slidably mounted on lifter 6.

Figure 6:
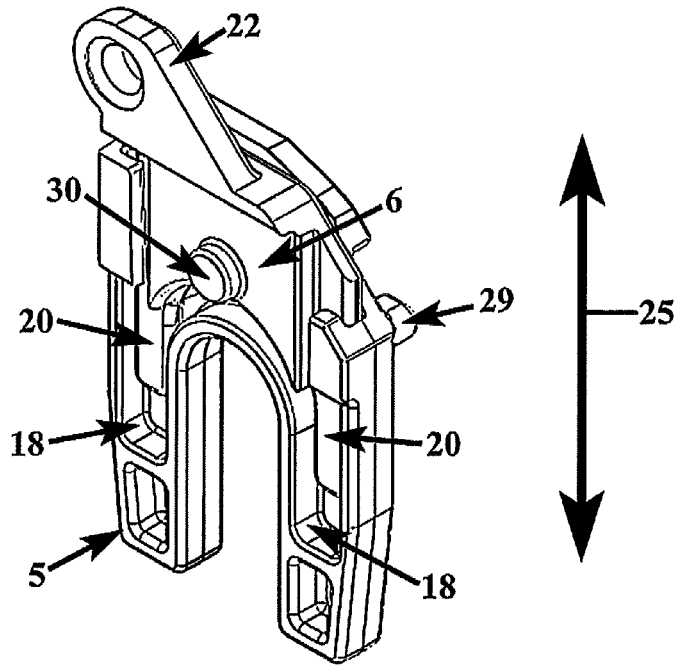
FIG. 6 depicts the lifter-fork combination, showing the slidable attachment of the fork and the lifter.

FIG. 6 depicts the lifter-fork component combination, showing the slidable attachment of fork component 5 to lifter 6. The slidable attachment is preferably established with fork component 5 having formed tracks 18 for receiving extensions 20 of lifter 6. Extensions 20 of lifter 6 are preferably leg extensions from the body of lifter 6 inserted within tracks 18 in a tongue-and-groove fashion, but may be slidably inserted in other combination schemes provided lifter 6 is capable of moving vertically in the direction of arrow 25 with respect to fork component 5. During lock actuation, fork component 5 is restricted to horizontal motion, while lifter 6, which is slidably attached to fork component 5, moves vertically with respect to fork component 5. Lifter 6 includes an attachment section 22 for pivotally securing handle 7. Attachment section 22 is preferably an extended segment from the body of lifter 6; but, may also be a pivot point within the body of lifter 6. When handle 7 is actuated, lifter 6 moves vertically, and the lifter-fork component combination slides horizontally with the movement of handle 7. The horizontal movement of fork component 5 is controlled by a guide track 27 attached to, or integral with, either main casing 1 or casing cover 8. In the preferred embodiment, guide track 27 is located on the inside surface of casing cover 8. Fork component 5 includes an extension or protrusion 29, protruding from said fork component body in a direction perpendicular to the horizontal motion of travel of fork component 5 that may be a pin or a slightly elongated oval or rectangular shaped segment for slidably engaging guide track 27. Extension or protrusion 29 may be integral with, or attached to, fork component 5. Conversely, fork component 5 may include a track segment on its body that receives an extension or protrusion from main casing 1. In either attachment scheme, fork component 5 is able to slide horizontally in guide track 27 along the elongated horizontal casing structure when induced by the actuation of handle 7.

Figure 7:
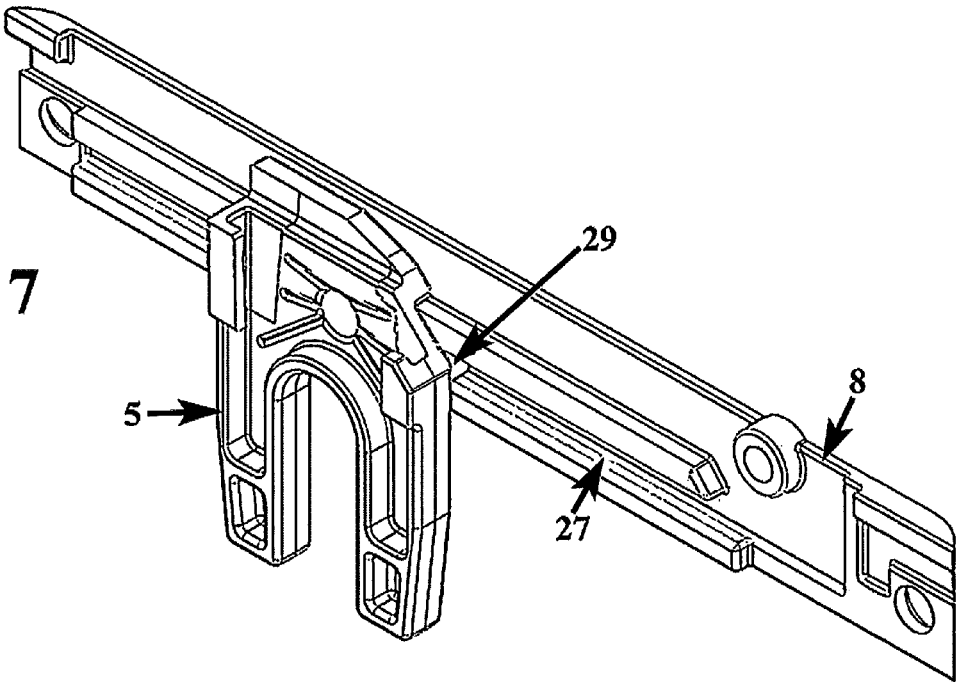
FIG. 7 depicts a plan perspective view of the preferred slidable attachment of the fork component to the main casing.

FIG. 7 depicts a plan perspective view of the preferred guide track 27 and the slidable attachment of fork 5 to the casing interior surface.

Figure 8A:
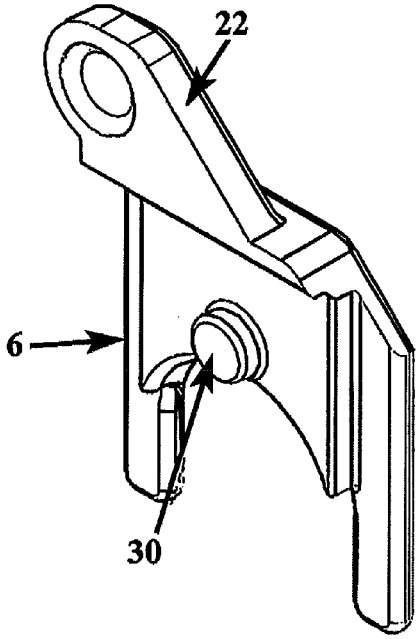
FIG. 8A is a perspective view of the lifter of the present invention, depicting a lifter pin.

Lifter 6 preferably includes a lifter pin or other shaped protrusion or extension 30, as depicted in FIG. 8A. Lifter pin 30 is attached to, or integrally formed with, lifter 6.

Figure 8B:
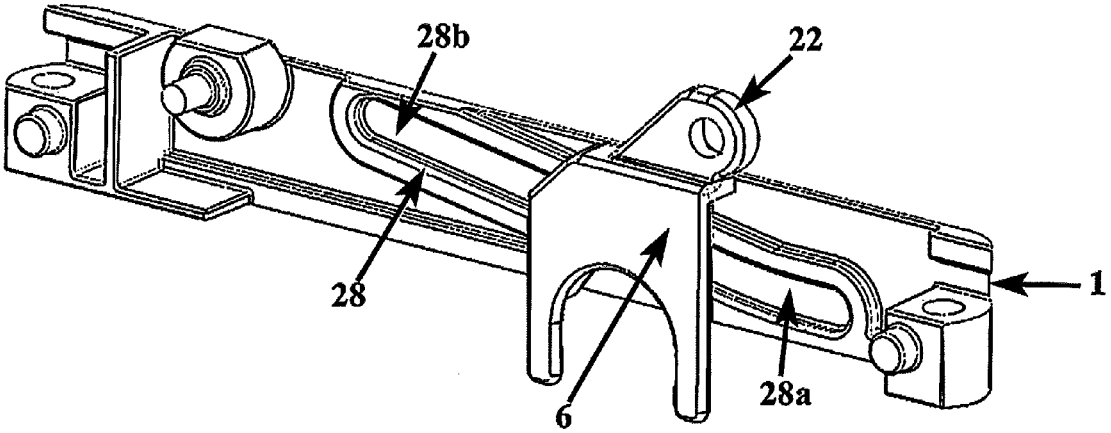
FIG. 8B is a perspective, cross-sectional view of the lifter of the present invention in slidable contact with the main casing via a track having an angled section.

FIG. 8B depicts a perspective, cross-sectional view of the slidable attachment of lifter 6 with main casing 1. Main casing 1 includes a track 28 for receiving lifter pin 30. Track 28 includes at least an angled section 28*b*, and may include a partially horizontal section 28*a*. Angled section 28*b* tapers vertically upwards from the horizontal. Track 28 may be a purely slanting track that gradually slants upwards from a lower point to a higher point on main casing 1. In a preferred embodiment, angled section 28*b* gradually raises lifter 6 from the horizontal over the length of travel as the lifter-fork component combination moves horizontally along main casing 1. Without rising, angled section 28*b* of track 28, a binding condition would be experienced as the fork component is moved through its horizontal transition. Thus, in the preferred embodiment, actuating handle 7 serves to move simultaneously lifter 6 to a raised position while the lifter-fork component combination is moved horizontally about the casing. The introduction of lifter 6 structurally allows handle 7 to fold over further, essentially flipping over to the other side of the casing without binding. This allows handle 7 "clearance" to rotate about its pivot points without requiring extra depth to the casing, and in fact, reducing the depth of the casing, making the casement window lock more flush with the mounting frame.

Figure 9:
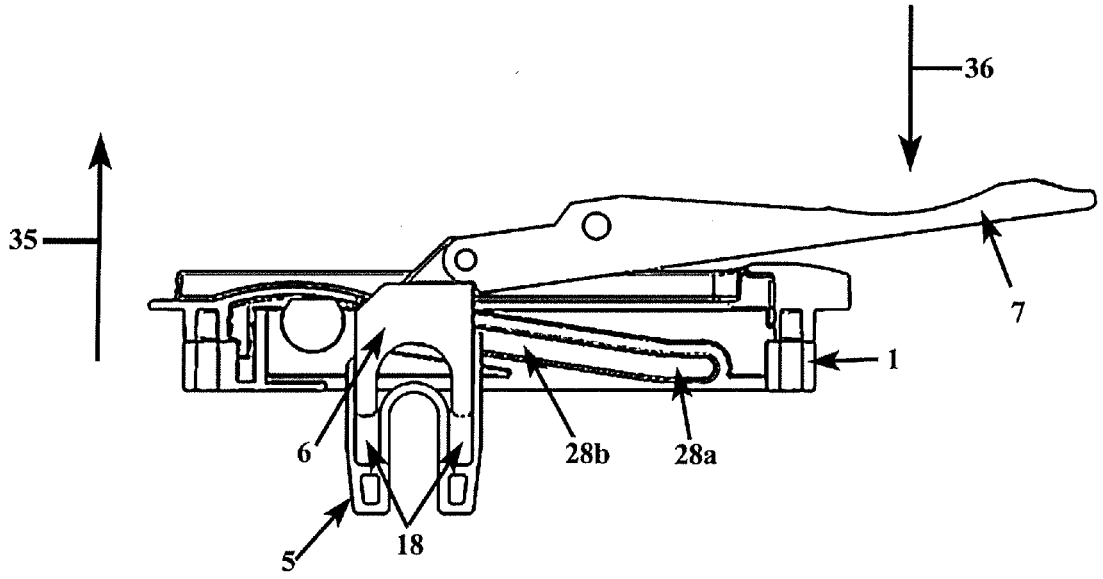
FIG. 9 depicts a cross-sectional view of the lock mechanism of the present invention, showing a raised lifter 6 as handle 7 actuates the lifter-fork combination.

FIG. 9 depicts a cross-sectional view of the preferred embodiment of the lock mechanism of the present invention, showing the rising lifter 6 as handle 7 actuates the lifter-fork component combination to an unlocked position. Lifter 6 is shown rising vertically (in the direction of arrow 35) in tracks 18 of fork component 5 as handle 7 rotates (in this example, clockwise, as indicated by arrow 36) and horizontally moves the lifter-fork component combination in a horizontal direction opposite the direction of handle rotation. Rotating with respect to hinge points on the restrictor arm 2 and lifter 6, handle 7 has sufficient clearance in this low profile design to completely flip over. In this manner, as depicted in FIG. 9, the lock mechanism is shown in an unlocked position.

Figure 10:
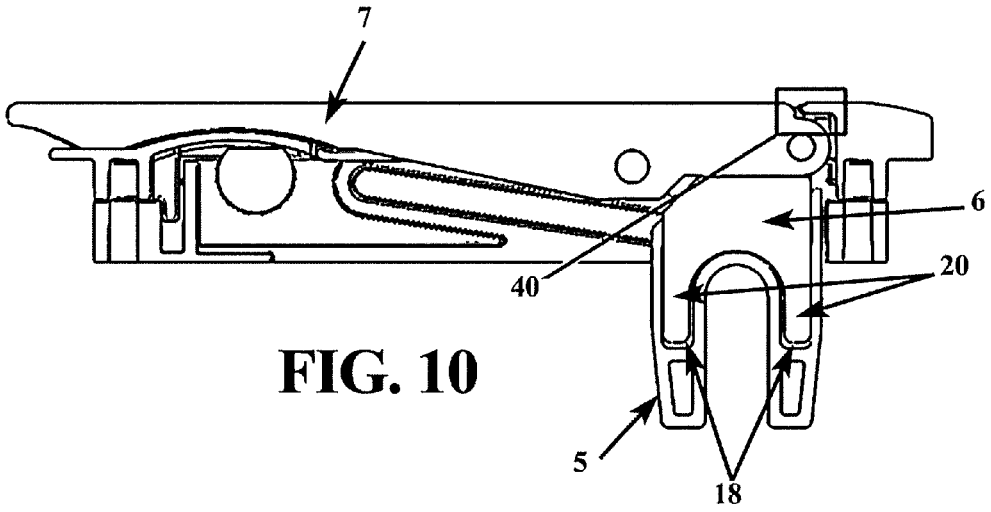
FIG. 10 depicts a cross-sectional view of the lock mechanism, showing a horizontal section on the escutcheon that allows the handle to tuck under the escutcheon when the lock mechanism is in the locked position.

FIG. 10 depicts a cross-sectional view of the lock mechanism, showing a horizontal section 40 on escutcheon 4 that allows handle 7 to tuck under escutcheon 4 when the lock mechanism is in the locked position. Lifter 6 is in the lower, horizontal section 28*a* of track 28, and extensions 20 of lifter 6 are seated in tracks 18 of fork component 5. Handle 7 returns from the unlocked position of FIG. 9 to a locked position, rotating with respect to hinge points on the restrictor arm 2 and lifter 6. Once again, handle 7 has sufficient clearance in this low profile design to completely flip over. In a preferred embodiment, a dead stop 42 is introduced between handle 7 and restrictor arm 2 to prevent handle 7 from rotating into escutcheon 4.

Figure 11:
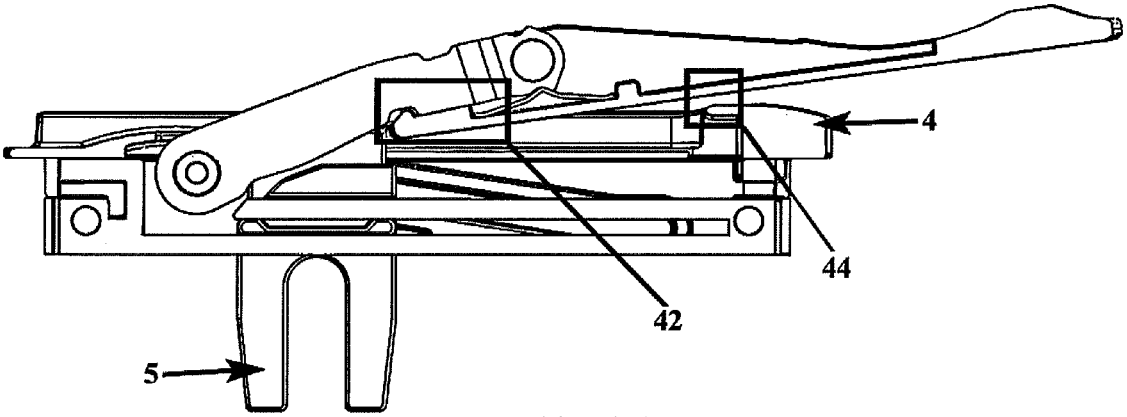
FIG. 11 depicts a cross-sectional view of the lock mechanism in an unlocked (raised lifter) position, showing a dead stop and a raised handle at its farthest rotational point to ensure clearance with the escutcheon.

FIG. 11 depicts a cross-sectional view of the lock mechanism in an unlocked position, showing dead stop 42, and a raised handle ensuring clearance 44 with escutcheon 4.

The relationship between the hinged points of the present invention interplays with the translation of the motion of handle 7 and fork component 5.

Figure 12:
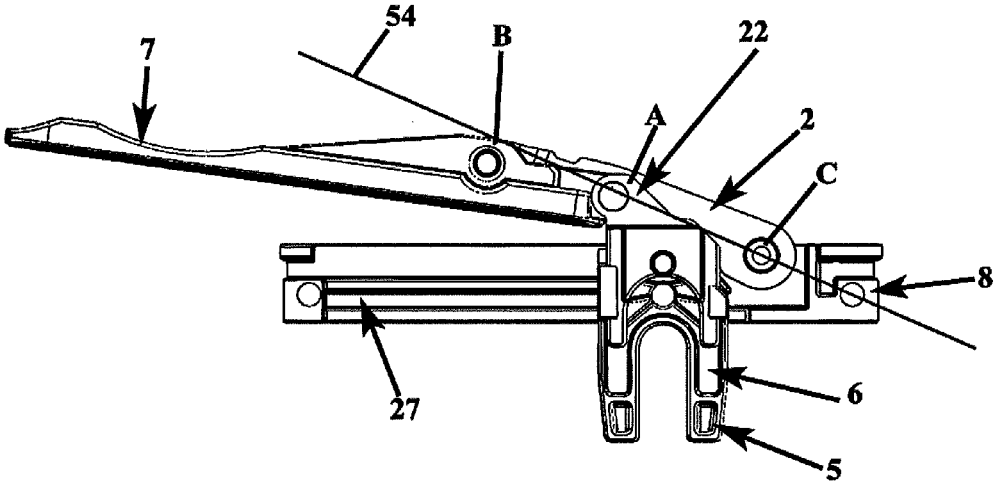
FIG. 12 is a cross-sectional view of the lock mechanism of the present invention with the main casing removed, and the positioning of over center linkage including three hinge points depicted with the handle shown in the unlocked position.

FIG. 12 is a cross-sectional view of the lock mechanism of the present invention with main casing 1 removed, depicting the positioning of three hinge points A, B, C when handle 7 is in the unlocked position. Hinge A is the pivotal junction of handle 7 and lifter 6 at the lifter attachment section 22. Hinge B is the pivotal junction of handle 7 with restrictor arm 2 at an intermediate point on handle 7. Hinge C is the pivotal junction of restrictor arm 2 with the casing, shown here on casing cover 8 with main casing 1 removed from view.

Figure 13:
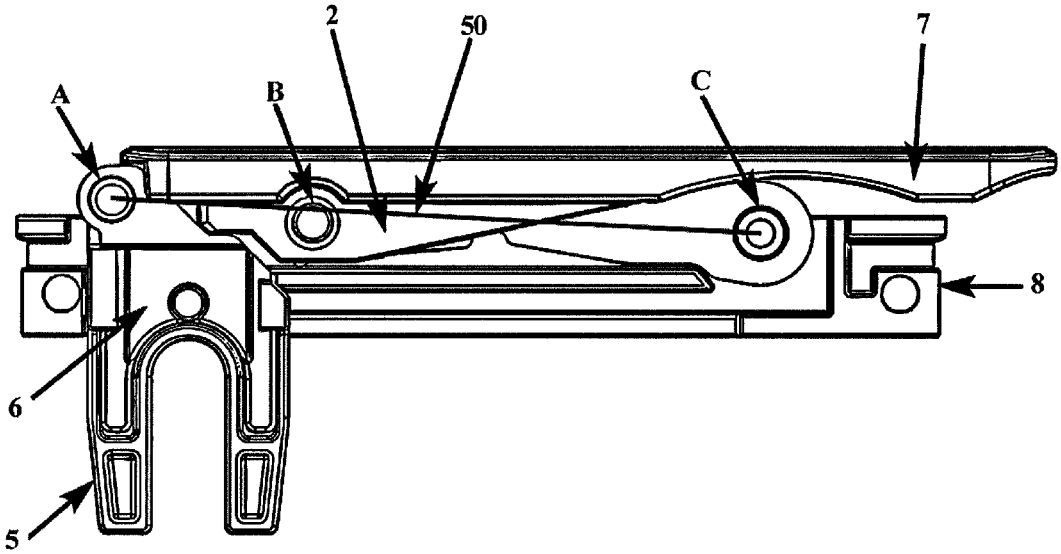
FIG. 13 depicts a cross-sectional view of the lock mechanism of the present invention in the locked position, showing the location of the hinge points in relation to one another in an over center configuration.

FIG. 13 depicts a cross-sectional view of the lock mechanism of the present invention in the locked position, showing the location of the hinge points in relation to one another. Hinge B is shown below the line of action 50 between hinges A and C. This relationship allows for the locking mechanism to utilize over center linkage at the ends of travel, and prevents the system from being back-driven (i.e., someone trying to break into the window by reversing the locking mechanism). Since hinge B is below the line of action 50 between hinges A and C, the system is not back drivable. In this manner, this configuration produces a "four bar linkage" design. It also allows handle 7 to move over a very wide operating angle and return to a flush or low profile position. The first of the four bar links is formed by handle 7 between the pivot 11 (hinge A) connected at lifter 6 and pivot 10 (hinge B) connected at restrictor arm 2. A second bar or link is formed by restrictor arm 2 and pivots at each end thereof. The third bar or link is effectively created by lifter 6 and the relative vertical motion between the pivot point 11 on lifter 6 (where lifter 6 connects to handle 7) and fork component 5. The fourth bar or link of the four bar linkage is created by fork component 5 and the horizontal sliding motion of fork 5 component relative to the fixed pivot point of the restrictor on the body (hinge C). The four bar linkage uses these four links pivotally connected at the ends (pivot points) so that the four links can move relative to each other.

When handle 7 is at either end of its travel, the four bar linkage design moves one pivot or hinge on the handle to an over center position relative to two of the three other pivot or hinge points. This over center position prevents the tie bar or lock bar from being back driven to the unlocked position when an "opening" force is applied to rotate handle 7. As shown in FIG. 13, when handle 7 is down, the pivot connection (hinge B) between handle 7 and restrictor arm 2 will have moved past and below line of action 50 defined between the pivot point on the lifter (hinge A) and the fixed pivot point between restrictor arm 2 and the body (hinge C).

At the other extreme, as shown in FIG. 12 with handle 7 fully open, the second pivot connection on the handle (the pivot point on lifter 6, hinge B) will have moved past and below the line of action 54 defined between the first pivot point on the handle at the lifter (hinge A) and the fixed pivot point between the restrictor arm and the body of the casing (hinge C). In each case, a hinge point moves "over center" to prevent the lock mechanism from being reverse driven. In other words, one of the four pivot points moves across a line of action that connects two other pivot points.

In a preferred embodiment, there is a detent at both ends of travel (open and locked). A detent spring 9 (refer to FIG. 2) is located between restrictor arm 2 and handle 7. Detent spring 9 provides tactile and audible indication that the lock mechanism has reached its end of travel. Additionally, a detent helps sustain handle 7 in the correct position at its end of travel.

Figure 14:
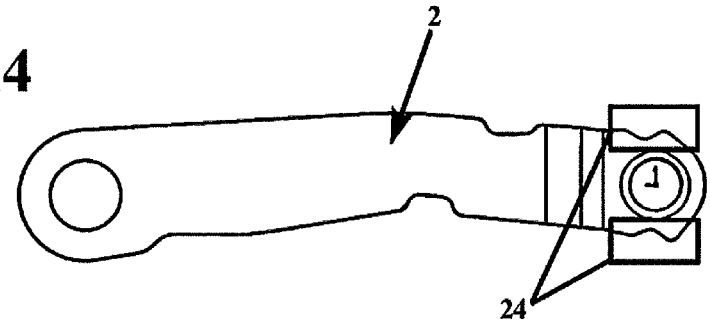
FIG. 14 depicts the restrictor arm with a preferred shaped indentation to receive and accommodate a detent spring.

FIG. 14 depicts restrictor arm 2 with a preferred shaped indentations 24 to receive and accommodate detent spring 9.

Figure 15A:
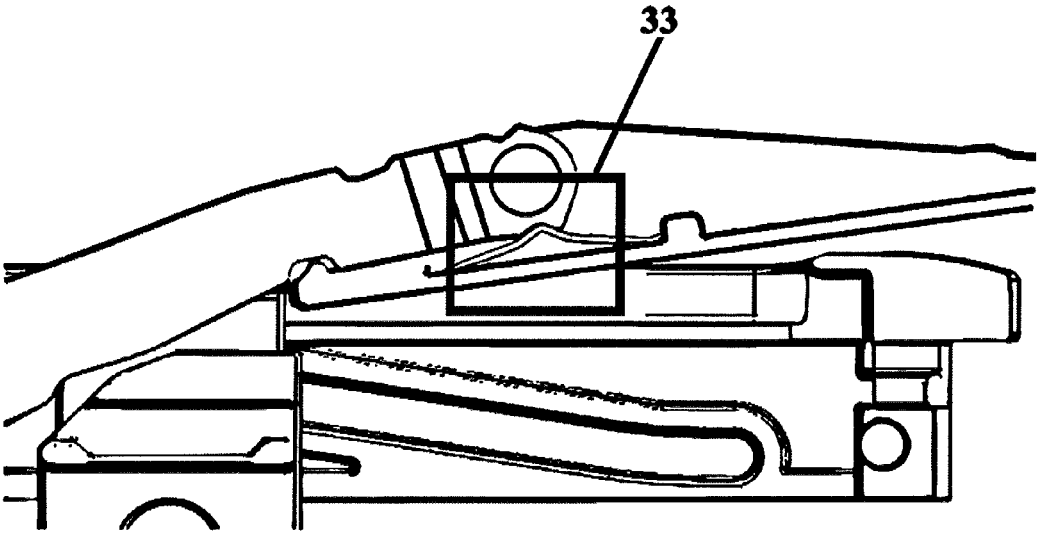
FIG. 15A is a cross-sectional view of the lock mechanism showing the unlocked detent position.
Figure 15B:
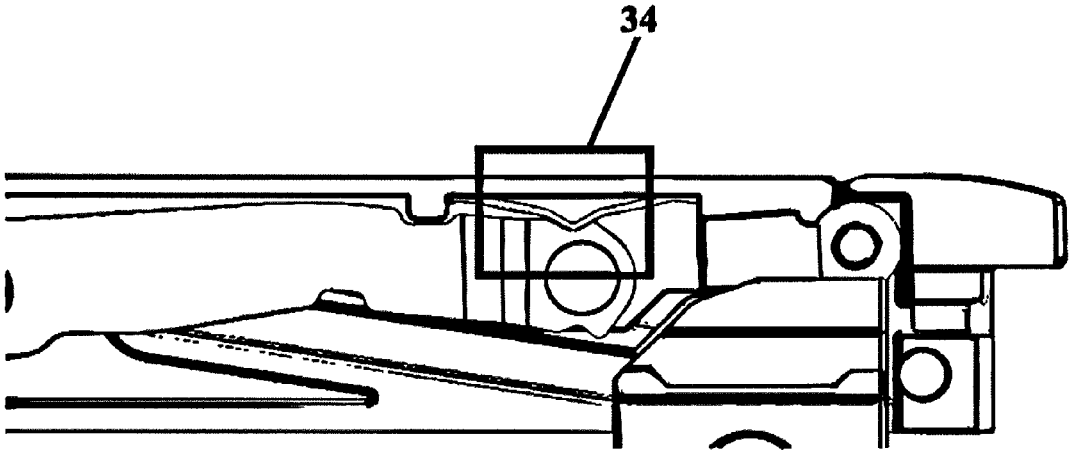
FIG. 15B is a cross-sectional view of the lock mechanism showing the locked detent position.

FIG. 15A depicts a cross-sectional view of the lock mechanism in the unlocked detent position 33, while FIG. 15B depicts a cross-sectional view the lock mechanism in the locked detent position 34.

To assist with handle stability during operation, a spring washer 3 is preferably employed between restrictor arm 2 and main casing 1. This spring washer, preferably a Belleville spring washer, is capable of providing large amounts of force with very little deflection, thus allowing the present invention to provide upwards of 75 pounds of load with two-tenths of one millimeter (0.2 mm) of deflection. Spring washer 3 also accommodates production variances while maintaining a pre-load force on restrictor arm 2.

Figure 16:
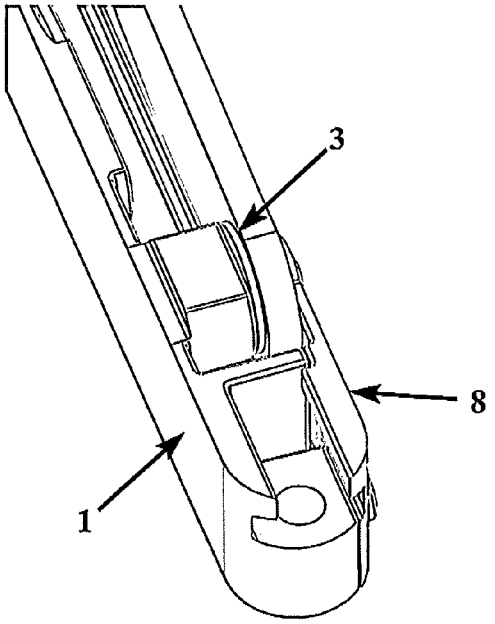
FIG. 16 depicts a partial perspective view of the main casing of the present invention with the retainer arm spring washer in place.

FIG. 16 depicts a partial perspective view of the main casing showing spring washer 3 in position.

In order to assemble the lock mechanism to the frame of a window, a retainer 60 is used. Retainer 60 provides a surface for mounting screws to bear down on.

Figure 17A:
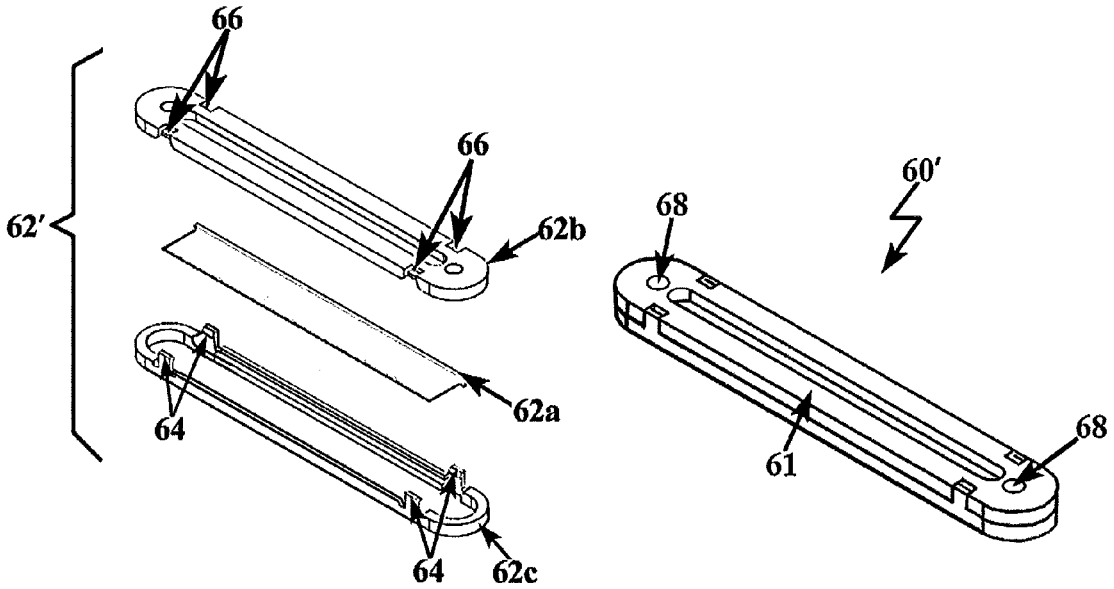
FIG. 17A is a perspective view of a first embodiment for a retainer for securing the lock mechanism of the present invention to a window frame.

FIG. 17A is an exploded view depicting the components of a first embodiment of a retainer. Retainer 60' includes a retainer body 61, and a brush seal 62' to prevent bugs from entering through the slotted portion of the lock when handle 7 is in the open, unlocked position. Brush seal 62' is preferably comprised of three components: a brush seal component 62*a* captured between two framed components 62*b,c*, which are preferably plastic components. Framed components 62*b,c* are preferably held together by a resilient clip action, as indicated by clips 64 and indents 66, although other attachment schemes common in the art may be employed.

Figure 17B:
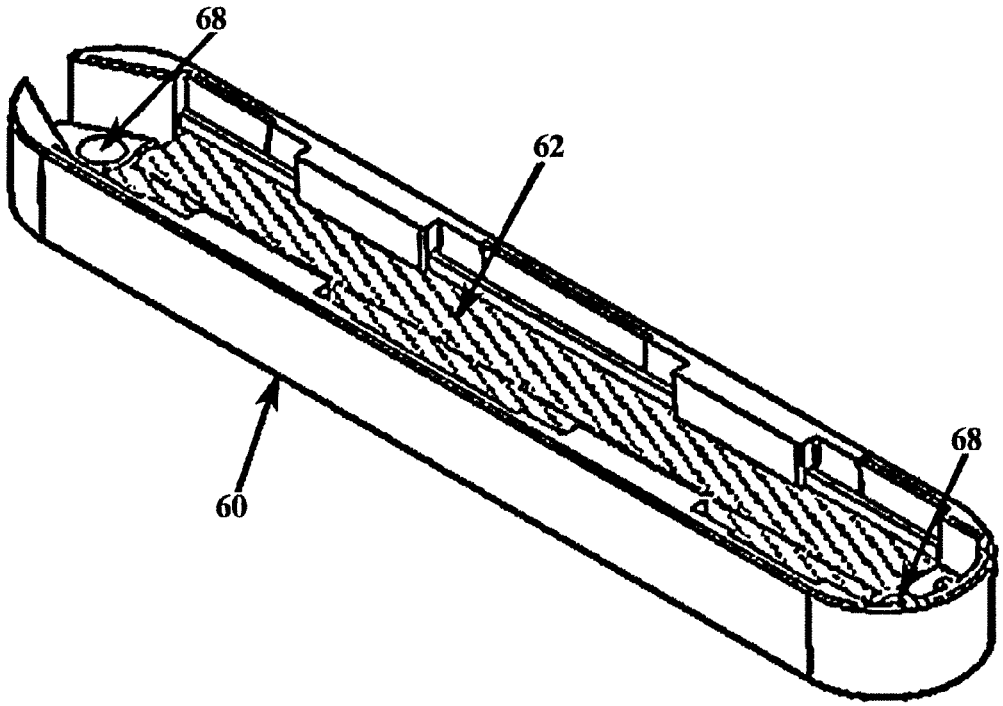
FIG. 17B is an exploded view of a second embodiment for a retainer for securing the lock mechanism of the present invention to a window frame.

FIG. 17B is a perspective view of a second embodiment for a retainer. Retainer 60 is an elongated, flush component, having a seal 62 to prevent bugs from entering through the slotted portion of the lock when handle 7 is in the open position. In both retainer embodiments, two screw holes 68 are introduced at approximately each end for mounting the flush lock mechanism.

Figure 18:
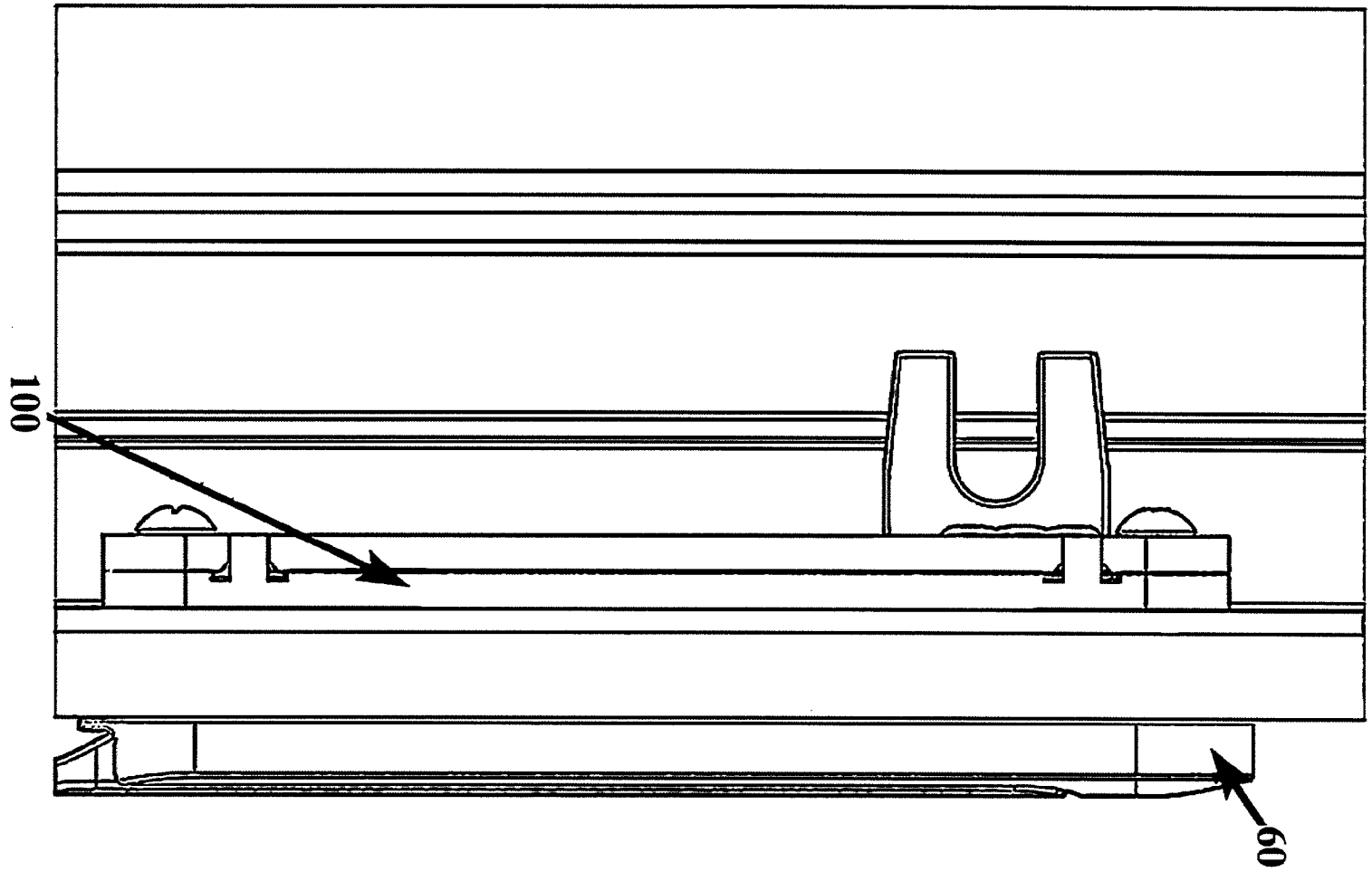
FIG. 18 depicts a side view of a mounted flush lock mechanism casement window lock of the present invention attached to a window frame using a retainer on the opposite side of the frame.

FIG. 18 depicts a side view of a mounted flush lock mechanism 100 to a window frame 70 using retainer 60 on the side opposite the flush lock mechanism 100.

Figure 19:
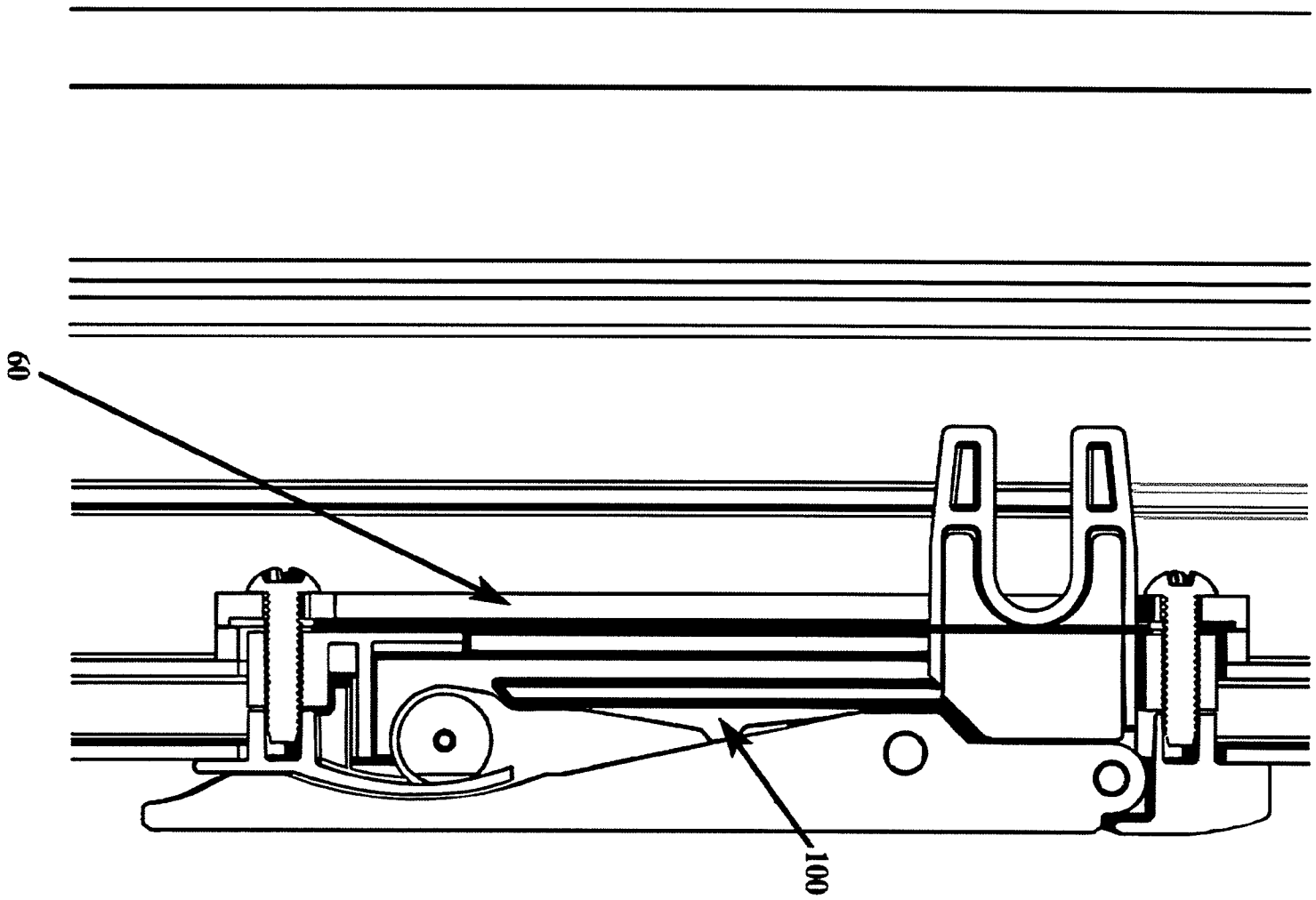
FIG. 19 is a cross-sectional view of the mounted flush lock mechanism casement window lock of the present invention secured by a retainer to the window frame.

FIG. 19 is a cross-sectional view of the mounted flush lock mechanism 100 secured by a retainer.

The present invention achieves a low profile casement window lock that far exceeds the profile depth of casement window locks of the prior art by employing a lifter-fork component combination and restrictor arm to establish a locking structure with multiple pivoting points that allows the handle to rotate completely with minimally required clearance in the casing housing. The pivoting action of the handle, lifter-fork component combination, and restrictor arm, allows the handle to move the fork component horizontally while rising or lower the lifter in relation to the fork component with the lifter in slidable communication with a slanted track on the internal surface of the casing. The multiple pivoting action provides for a four bar linkage that secures the casement window lock in either the open, unlocked position, or closed, locked position, and prevents back driving the lock mechanism in the reverse direction.

While the present invention has been particularly described, in conjunction with the specific preferred embodiment(s), it is evident that many alternatives, modifications, and variations will be apparent to those skilled in the art, in light of the foregoing description. It is therefore contemplated that the appended claims will embrace any such alternatives, modifications, and variations as falling within the true scope and spirit of the present invention. Thus, having described the invention, what is claimed is:

The invention claimed is:

1. A casement window lock for securing a window sash to a casement window frame, said lock comprising:

a casing having an elongated horizontal sidewall with a shorter vertical dimension, said casing including elongated side members, and tracks on at least one side member extending along an inside surface thereof, said tracks including a first track substantially horizontal and extending along said casing elongated horizontal sidewall, and a second track having at least one angled portion extending vertically relative to said first track's horizontal position;

a restrictor arm pivotally attached at one end to said casing, and pivotally attached at the other end to an intermediate point between a free first end and a second end of a handle;

a fork component including:

an attachment portion for engaging a lock bar;

an attachment for slidably retaining a lifter;

a protrusion for slidably engaging said first track; and said lifter in slidable contact with said fork, including:

an extending protrusion for slidably engaging said second track;

an attachment for pivotally connecting said lifter to said second end of said handle;

said handle in pivotal communication with said restrictor arm at one end of said handle, and in pivotal communication with said lifter at an intermediate point on said handle, wherein said handle pivotably attaches to said lifter, and is not directly attached to said casing; and wherein, when said handle is rotated to unlock said lock, said handle pivots about said lifter and said restrictor arm, respectively, causing said fork component to traverse horizontally in a first direction about said first track while simultaneously causing said lifter to shift vertically as said lifter traverses said second track, and when said handle is rotated to lock said lock, said handle pivots about said lifter and said restrictor arm, respectively, causing said fork component to traverse horizontally in a second direction opposite said first direction about said first track while simultaneously causing said lifter to shift vertically as said lifter traverses back on said second track.

2. The casement window lock of claim 1 wherein said fork component's attachment for slidably retaining a lifter includes a lifter track for slidably communicating with said lifter such that a portion of said lifter fits within said lifter track and moves vertically relative to said fork component when actuated by said handle.

3. The casement window lock of claim 1 including a plurality of hinges or pivot points forming an over center linkage to prevent back driving said lock.

4. A casement window lock for securing a window sash to a casement window frame, said lock comprising:

a casing having an elongated horizontal sidewall with a shorter vertical dimension, said casing including elongated side members, and tracks on at least one side member extending along an inside surface thereof, said tracks including a first track substantially horizontal and extending along said casing elongated horizontal sidewall, and a second track having at least one angled portion extending vertically relative to said first track's horizontal position;

a restrictor arm pivotally attached at one end to said casing, and pivotally attached at the other end to a handle;

a fork component including:

an attachment portion for engaging a lock bar;

an attachment for slidably retaining a lifter;

a protrusion for slidably engaging said first track; and said lifter in slidable contact with said fork, including:

an extending protrusion for slidably engaging said second track;

an attachment for pivotally connecting said lifter to said handle;

said handle in pivotal communication with said restrictor arm at one end of said handle, and in pivotal communication with said lifter at an intermediate point on said handle; and wherein, when said handle is rotated to unlock said lock, said handle pivots about said lifter and said restrictor arm, respectively, causing said fork component to traverse horizontally in a first direction about said first track while simultaneously causing said lifter to shift vertically as said lifter traverses said second track, and when said handle is rotated to lock said lock, said handle pivots about said lifter and said restrictor arm, respectively, causing said fork component to traverse horizontally in a second direction opposite said first direction about said first track while simultaneously causing said lifter to shift vertically as said lifter traverses back on said second track;

a plurality of hinges or pivot points forming an over center linkage to prevent back driving said lock, wherein said over center linkage includes:

a first hinge point rotatably joining said handle to said lifter;

a second hinge point rotatably joining said handle to said restrictor arm;

a third hinge point rotatably joining said restrictor arm to said casing; and such that when said handle is in an unlocked position, said first hinge point is between said second and third hinge points, and said second hinge point is below an action line connecting said first and third hinge points, and when said handle is in said locked position, said second hinge point is between said first and third hinge points, and said second hinge point is below an action line connecting said first and third hinge points.

5. The casement window lock of claim 1 wherein said fork component's protrusion for slidably engaging said first track includes an extension attached to or integral with said fork component, extending perpendicular to said horizontal casing sidewall for slidable engagement within said first track.

6. The casement window lock of claim 1 wherein said lifter's protrusion for slidably engaging said second track is attached to or integral with said lifter, extending perpendicular to said horizontal casing sidewall for slidable engagement with said second track.

* * * * *